United States Patent [19]

Hall

[11] 4,083,050

[45] Apr. 4, 1978

[54] DUAL BAND MONOPOLE OMNI ANTENNA

[75] Inventor: Roger D. Hall, Encino, Calif.

[73] Assignee: The Bendix Corporation, North Hollywood, Calif.

[21] Appl. No.: 719,488

[22] Filed: Sep. 1, 1976

[51] Int. Cl.[2] ..... H01Q 9/38

[52] U.S. Cl. ..... 343/729; 343/708; 343/722; 343/725

[58] Field of Search ..... 343/722, 725, 729, 830, 343/831, 708, 749, 846

[56] References Cited

U.S. PATENT DOCUMENTS

| | | | |
|---|---|---|---|
| 3,210,764 | 10/1965 | Anderson et al. | 343/708 |
| 3,453,628 | 7/1969 | Dolan | 343/708 |

*Primary Examiner*—Alfred E. Smith
*Assistant Examiner*—David K. Moore
*Attorney, Agent, or Firm*—Robert C. Smith; William F. Thornton

[57] ABSTRACT

A dual mode high-frequency printed circuit radar antenna for aircraft use having good aerodynamics is provided in the form of a printed circuit antenna molded into a smooth, blade-like protective shield. The antenna, printed on an epoxy glass substrate carried on a mounting plate including, integrated in series, a stub monopole element and a larger area capacitive loading member for I-band reception, an inductive member whose impedance is very high at I band and a monopole element which adds sufficient length that the entire conductor track acts as a quarter wave length monopole at C and D bands. At I band the stub monopole element and capacitive loading is isolated from the added monopole element by the high impedance inductive member, making for good I-band performance.

6 Claims, 3 Drawing Figures

DUAL BAND MONOPOLE OMNI ANTENNA

BACKGROUND OF THE INVENTION

For modern high-speed aircraft, there is a need for wide-band, high-frequency antennas which are fastened to the exterior of the aircraft and which impose the least possible aerodynamic load. For some time such an antenna has been supplied in the form of a printed circuit antenna element carried on a dielectric substrate fastened to a mounting flange and molded into a housing consisting of a smoothly faired plastic blade. This antenna, which was designed for the C and D bands (750 to 1200 MHz), has been very successful. Recently a requirement has arisen for such an antenna which is also capable of receiving signals in I band (7.0 to 12.0 GHz). Since I band is substantially displaced in frequency from C and D bands, this requirement would normally dictate a separate antenna; however, even relatively small appendages on modern high-speed aircraft cannot always be attached without adverse effects on operation of the aircraft. It would be desirable, therefore, to accomodate the I band requirement without significant change in the external configuration of the C and D-band antenna design.

SUMMARY OF THE INVENTION

To meet the requirements of providing an antenna for high-speed aircraft which will provide coverage of the C and D bands essentially the same as current C and D-band antennas, whose external dimensions are essentially the same as the existing C and D band antenna, and which can also provide good I-band coverage with no significant degradation in C and D-band performance, applicant combined a capacitance loaded stub at I band with a low-frequency monopole section element covering C and D bands. An inductive section was added between the capacitance loaded member and the monopole section which was designed to provide very high impedance at I band. In this way the disk-loaded I-band stub and the C and D-band member are effectively isolated at I band, and the I-band section performed very well. At C and D bands, the overall element serves as a monopole which performed essentially as well as the prior art C and D-band antenna. This was then formed in a printed circuit configuration with the I-band element, the large area capacitive loading member, the inductive member and the additional monopole section all formed as a printed circuit on an epoxy glass dielectric substrate. This printed circuit element was then attached to a mounting flange and enclosed in a plastic blade-shaped housing essentially identical in external configuration to that used on the existing C and D-band antennas.

DESCRIPTION OF THE PREFERRED EMBODIMENT

Figure 1:
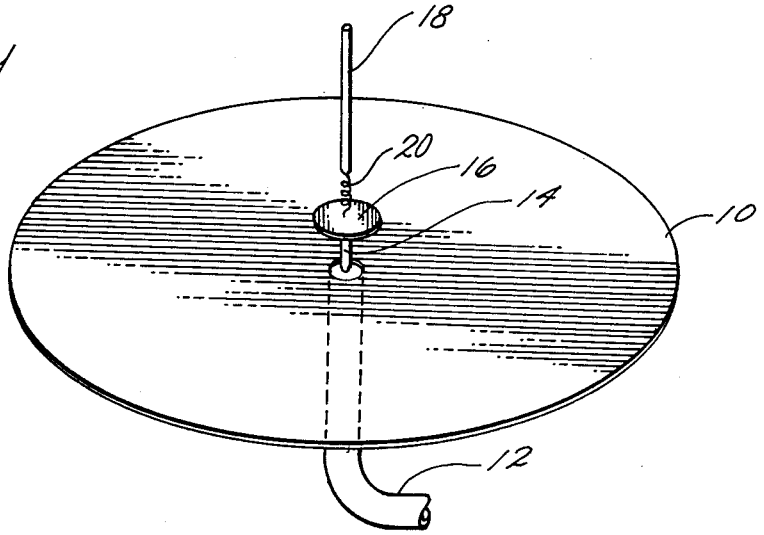
FIG. 1 is a perspective schematic view of a first embodiment of my invention.

Referring now to FIG. 1, it will be seen that an antenna is shown consisting of a large-area ground plane 10 having a center aperture through which is connected a coaxial line 12. The center conductor of the coaxial line is connected to a short stub 14 which is dimensioned such that it constitutes a pseudo quarter-wave monopole antenna at I-band frequencies (7.0 to 12.0 GHz). Fastened to the top of stub 14 is a capacitive disk loading member 16. A monopole member 18 completes the length required for the C and D-band monopole section and is spaced a short distance from the capacitive loading disk 16 by means of an inductor 20. The characteristics of inductor 20 are chosen such that at I band its impedance is sufficiently high that stub 14 and capacitive disk 16 is effectively disconnected from monopole member 18.

Figure 2:
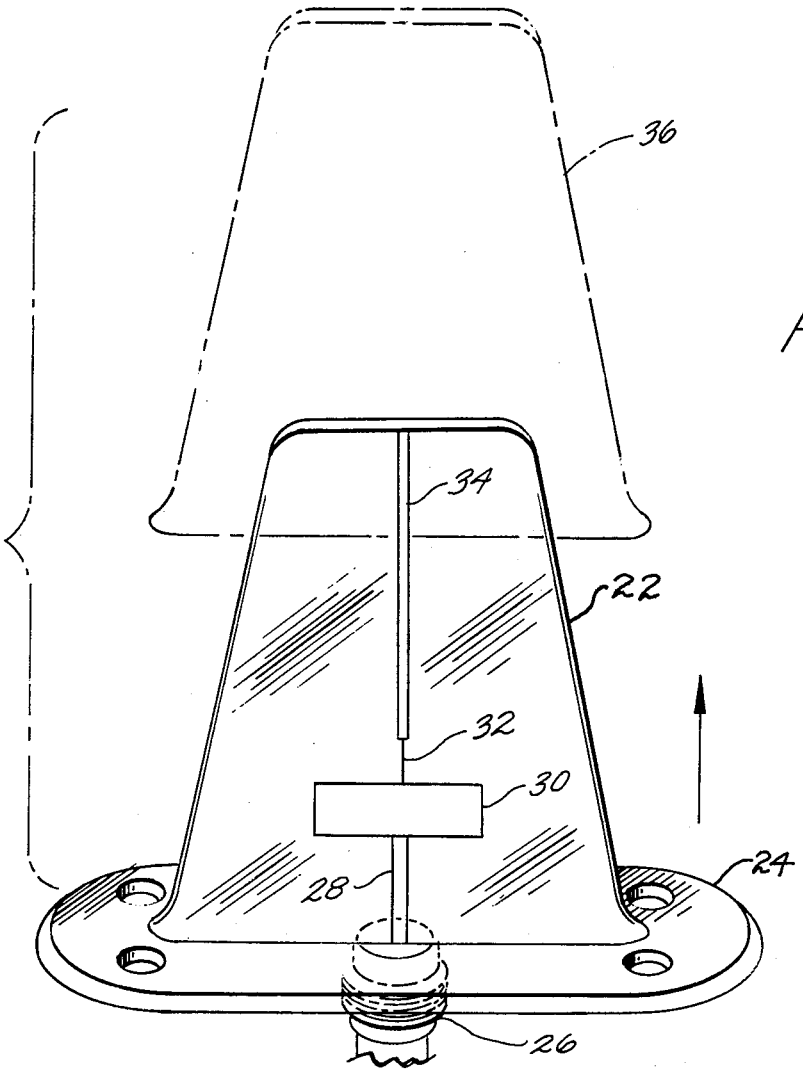
FIG. 2 is a perspective, partially exploded view of a second embodiment of my invention including its protective cover.
Figure 3:
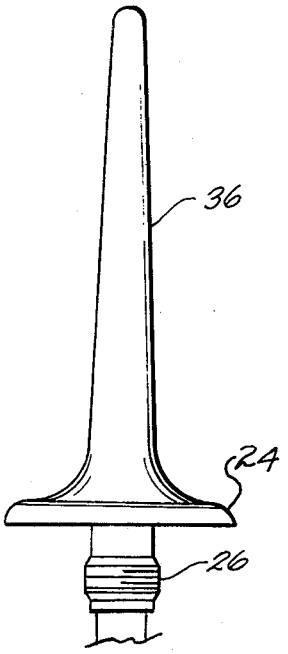
FIG. 3 is an end view of the embodiment of FIG. 2 with the cover installed in position.

FIGS. 2 and 3 show a printed circuit production version of the antenna shown schematically in FIG. 1. In FIG. 2 a flat dielectric plate 22 of epoxy glass is shown carried on a mounting flange 24 which is designed to be fastened to the surface of an aircraft. Also fastened to flange 24 is a connector 26 which terminates a coaxial antenna lead. The printed circuit conductor pattern on substrate 22 consists of a pseudo quarter wave I-band stub 28, a capacitive loading element 30 in the form of a flat plate of significant area, a high-frequency inductive member 32 and the monopole section 34 which is of such length that the entire section between the bottom of stub 28 and the top of monopole 34 provides a C and D-band monopole element. Shown in phantom above the plate 22 is a plastic protective envelope 36 which is normally attached to flange 24 in such manner that it encloses and covers plate 22 and the printed circuitry thereon. The same structure is also shown in FIG. 3 with the cover 36 attached to the flange 24. Again, it will be recognized that the center conductor of the coaxial connector 26 is electrically connected to the stub 28.

My invention herein has been described in reference to a dual mode antenna covering C and D band in combination with I bands but is not limited to these frequency ranges. The same technique would permit expanding to a printed circuit antenna designed for other frequency bands into still other bands with substantially higher frequencies. The dimensions of the substrate will, of course, be governed by the height (or length) necessary to provide a monopole for the lowest frequency band which it is desired to receive. And while the housing has been described as a "blade" which provides a desired aerodynamic shape, other housing shapes may prove advantageous, depending upon the exact location where it is desired to place the antenna on the associated aircraft.

I claim:

1. A wide-band high-frequency antenna for reception over separated frequency bands including mounting and support means, a coaxial connector fastened to said mounting and support means, an upstanding member of dielectric material carried on said mounting and support means and a conductor track on the surface of said member constituting the radiating element of said antenna electrically connected to the center conductor of said coaxial connector including, connected in series, a highfrequency stub element, a capacitive loading member for said stub element at the higher of said frequency bands, an inductive member having very high impedance at the higher of said frequency bands and low impedance at the lower of said frequency bands, and a monopole element aligned with said stub, said capacitive element and said inductive element, the combined length of said elements being such as to provide a one-quarter wave length monopole antenna at the lower of said frequency bands.

2. A wide-band high-frequency antenna as set forth in claim 1 wherein said conductor track is a printed circuit on the surface of said dielectric member.

3. A wide-band high-frequency antenna as set forth in claim 1 wherein said high-frequency stub and said capacitive member constitute a pseudo quarter-wave monopole section with capacitive loading at the higher of said frequency bands.

4. A wide-band high-frequency antenna as set forth in claim 1 wherein said inductive member effectively isolates said monopole element from said stub and said capacitive loading member at the higher of said frequency bands.

5. A wide-band high-frequency antenna for reception over two separated frequency bands adapted to be mounted on an external surface of a vehicle including a mounting flange for attaching said antenna to said surface, a coaxial connector attached to said flange, an upstanding member of thin deielectric material supported on said flange and a printed circuit conductor track on the surface of said member constituting the radiating element of said antenna including, connected in series, a high-frequency stub element vertically from said flange and connected to the center conductor of said coaxial connector, a capacitive plate element connected to said stub element, an inductive element comprising a very narrow straight conductor having very high impedance at the higher of said frequency bands, and an additional monopole element aligned with said stub element, said plate and said inductive section and connected to said inductive section, the combined length of said elements being such as to provide a one-quarter wave length monopole antenna at the lower of said two frequency bands.

6. A wide-band high-frequency antenna as set forth in claim 5 wherein a blade-shaped protective cover of dielectric material is placed over said dielectric member and fastened to said mounting flange.

* * * * *